US006677257B2

(12) United States Patent
Brasier

(10) Patent No.: US 6,677,257 B2
(45) Date of Patent: Jan. 13, 2004

(54) FABRIC FOR TENNIS BALL COVERING AND METHOD FOR MANUFACTURING THE SAME

(75) Inventor: Alan John Brasier, Stonehouse (GB)

(73) Assignee: Milliken Industrials Limited, Bury (GB)

( * ) Notice: Subject to any disclaimer, the term of this patent is extended or adjusted under 35 U.S.C. 154(b) by 409 days.

(21) Appl. No.: 09/742,197

(22) Filed: Dec. 20, 2000

(65) Prior Publication Data

US 2001/0021617 A1 Sep. 13, 2001

(30) Foreign Application Priority Data

Dec. 24, 1999 (GB) ..... 9930642
May 16, 2000 (GB) ..... 0011646

(51) Int. Cl.[7] ..... D04H 1/08; D03D 9/00

(52) U.S. Cl. ..... 442/321; 442/20; 442/25; 442/323; 442/324; 428/132; 428/133

(58) Field of Search ..... 442/20, 25, 321, 442/323, 324; 428/132, 133

(56) References Cited

U.S. PATENT DOCUMENTS

| | | | | |
|---|---|---|---|---|
| 1,287,766 | A | 12/1918 | Saunders | |
| 1,376,778 | A | 5/1921 | Orr | |
| 3,065,520 | A | 11/1962 | Schmidt | 28/72 |
| 3,396,970 | A | 8/1968 | Fraser, Jr. et al. | 273/61 |
| 3,451,885 | A | 6/1969 | Klein | 161/80 |
| 3,558,413 | A | 1/1971 | Wall | 161/91 |
| 3,684,284 | A | 8/1972 | Tranfield | 273/61 R |
| 4,022,469 | A | 5/1977 | Lacoste et al. | 273/61 C |

(List continued on next page.)

FOREIGN PATENT DOCUMENTS

| | | | |
|---|---|---|---|
| DE | 2208413 | | 8/1973 |
| DE | 34 17 539 | A1 | 11/1985 |
| DE | 35 42 151 | A1 | 6/1987 |
| DE | 37 03 225 | A1 | 8/1988 |
| DE | 38 04 104 | | 8/1988 |
| DE | 42 42 307 | A1 | 6/1994 |
| EP | 0 022 961 | | 1/1981 |
| EP | 0 342 287 | | 11/1989 |
| EP | 0 411 647 | A1 | 2/1991 |
| EP | 0 612 876 | A1 | 8/1994 |
| EP | 0 922 472 | A1 | 6/1999 |
| EP | 0 974 378 | A2 | 1/2000 |
| FR | 1.158.200 | | 6/1958 |
| FR | 2 248 360 | | 5/1975 |
| GB | 1007632 | | 10/1965 |
| GB | 1016551 | | 1/1966 |
| GB | 1060076 | | 2/1967 |
| GB | 1074779 | | 7/1967 |
| GB | 1081882 | | 9/1967 |
| GB | 1085097 | | 9/1967 |
| GB | 1088393 | | 10/1967 |
| GB | 1088593 | | 10/1967 |
| GB | 1470556 | | 4/1977 |
| GB | 1498732 | | 1/1978 |
| GB | 2002639 | | 2/1979 |
| GB | 1556039 | | 11/1979 |
| GB | 2 053 697 | A | 2/1981 |
| GB | 1588380 | | 4/1981 |
| GB | 1602198 | | 11/1981 |
| GB | 2 145 337 | A | 3/1985 |
| GB | 2 150 443 | A | 7/1985 |
| GB | 2 181 959 | A | 5/1987 |
| GB | 2 200 849 | A | 8/1988 |
| GB | 2 221 624 | A | 2/1990 |
| GB | 2 314 778 | A | 1/1998 |
| WO | 99/47213 | | 9/1999 |

*Primary Examiner*—Glenn Caldarola
*Assistant Examiner*—Alexis A. Wachtel
(74) *Attorney, Agent, or Firm*—RatnerPrestia

(57) ABSTRACT

A composite fabric material for use in covering sports balls comprising two or more separate fabric materials affixed together to form a single material, the materials including at least an outer layer and a backing or support layer, is described.

21 Claims, 10 Drawing Sheets

U.S. PATENT DOCUMENTS

| | | | | |
|---|---|---|---|---|
| 4,305,583 | A | 12/1981 | Tandon et al. | 273/61 R |
| 4,318,544 | A | 3/1982 | Brine, Jr. | 273/65 EG |
| 4,340,222 | A | 7/1982 | Kerkenbush et al. | 273/61 R |
| 4,616,828 | A | 10/1986 | Haythornthwaite | 273/61 R |
| 5,144,730 | A | 9/1992 | Dilo | 28/109 |
| 5,211,788 | A | 5/1993 | Song | 156/148 |
| 5,374,059 | A | 12/1994 | Huang | 273/75 |
| 5,735,761 | A | 4/1998 | Palmquist | 473/596 |
| 5,830,092 | A | 11/1998 | Meeks | 473/606 |
| 6,012,997 | A | 1/2000 | Mason | 473/594 |
| 6,227,992 | B1 | 5/2001 | Brasier | 473/606 |

FABRIC FOR TENNIS BALL COVERING AND METHOD FOR MANUFACTURING THE SAME

FIELD OF THE INVENTION

This invention relates to a fabric for use in the manufacture of tennis balls and to a method of manufacturing the same.

BACKGROUND OF THE INVENTION

Conventionally, tennis balls are manufactured with the use of a textile having a felted surface. This means that the outer surface of the ball presents a layer of entangled fibres. The felt has a significant influence on the flight characteristics and feel (play characteristics) of a tennis ball. Over the last 50 years a large number of attempts have been made to propose other types, (generally cheaper or having an increased resistance to wear) of non-felted tennis ball coverings but they have been found unsuccessful in equaling the feel and characteristic of the felted fabric and to replace the classic felted covering.

As stated above, tennis balls are manufactured with an outer surface covered with a textile material having a felted surface. The International Tennis Federation Rules of Tennis 2000 states (Rule 3a): "The ball shall have a uniform outer surface consisting of a fabric cover . . . ".

The back surface of the material is smoother and is designed to support the felted outer surface and, when coated with adhesive, provide the necessary characteristics of stretch and adhesion to allow the material to be bonded to the ball.

The conventional method of making a tennis ball felt uses weaving technology to produce a fabric that is first raised or "napped" and then milled to form the felted surface. Alternatively, needlepunch technology can be used whereby a felt is produced from layered webs of fibre that are needled together with or without a supporting scrim. The needlefelt so produced may or may not be subjected to further finishing processes.

Both these methods of felt manufacturing produce a felt with characteristics which are a compromise between the requirements for ball manufacturing and the end product requirements.

Thus, U.S. Pat. No. 4,874,169 describes a game ball having various types of depressions on one of its hemisphere. One particular ball is a tennis ball (see FIG. 5) having one hemisphere covered with a standard tennis ball covering and another covered by a plastic-like smooth material having grooves radiating from its pole.

It has been further proposed in U.S. Pat. No. 1,287,766 to replace the standard fabric covering of the tennis ball by a smooth and soft rubber-like material. Said rubber covering is provided with regular holes in order to mimic the skin friction of a standard tennis ball felt cover.

U.S. Pat. No. 4,616,828 describes a tennis ball having a deep groove extending in the rubber spherical core of the ball in order to control the air turbulence during the ball trajectory. In one embodiment it is proposed to cover the ball with a non-felted fabric made of woven synthetic filaments or fibres. These synthetic filaments are woven so as define a series of rectangular areas.

In U.S. Pat. No. 1,376,778 it is proposed to protect the seam of the textile and to produce a better controlling effect by compressing the outer fabric once provided on a tennis ball at various points along the seam. However, applying pressure to the tennis ball is not recommended as the pressure may alter the internal shape of the core of the ball. Also, compressed area obtained by such compression method are not very wear-resistant and disappear rapidly when used on a tennis ball.

A problem with the modern game of tennis is that as players become more and more powerful, less skill is needed to play the game. The game is fast and rarely are more than two or three shots played in a rally. This makes the games less enjoyable for spectators.

It would be desirable to have a felted tennis ball covering which would allow for greater control over the flight of the tennis ball. More particularly it would be desirable to have a felted tennis covering which, when applied to a tennis ball, alters substantially the flight and/or rebound characteristics when spin is imparted by the player to the ball. This would allow tennis players by imparting spin to various degrees to cause the ball to vary its course to a differing extent as it flies through the air and also to achieve a greater deviation from the expected path of the ball's rebound from the court.

SUMMARY OF THE INVENTION

It was proposed by the Applicant in EP-A-0,974,378 to provide a fabric for use as a tennis ball covering wherein the felted outer surface was composed of entangled fibres and was provided with a three dimensional pattern thereon. Advantageously the three dimensional pattern could comprise a series of depressed and non-depressed areas.

It was also proposed that the fabric comprises at least a support layer and an outer layer, said outer layer having a pattern cut through it and being affixed on the support layer to create said three dimensional pattern. Advantageously, the support layer included a scrim and constituted between 40 and 70% of the weight of the fabric.

Various methods of manufacturing such a fabric were proposed. For example, by interlacing warp and weft threads and generating a three dimensional pattern by varying the interlacing frequency of the warp and weft threads. Alternatively, a three dimensional pattern was created on the fabric by varying the entanglement rate of the fibres of the felted outer surface or by providing at least a support layer and an outer layer, said outer layer having a pattern cut through it and affixing said outer layer on the support layer to create said three dimensional pattern.

Whilst EP-A-0,974,378 discloses the concept of using a composite fabric material for tennis balls, this is only in the context of producing dimpled tennis balls. It has now been realised that a non-dimpled tennis ball can be manufactured by the same technique to provide a fabric material suitable for use as a sports ball covering which enables both the ease of closely fitting a woven fabric around the curvature of the ball, with the benefits of a non-woven outer surface.

U.S. Pat. No. 5,830,092 also describes a composite fabric material for tennis balls, but the face side of that fabric (which forms the outer surface of the covered ball) is formed from non-woven needlefelt and addresses only the difficulties associated with needlepunched felt fabrics.

This invention relates to the production of a composite fabric material for use in covering sports balls (especially tennis balls), and to the balls so produced.

The composite fabric material of the present invention is produced from two or more separate fabric materials which are then laminated together to form a single material.

The invention enables the production of a felted textile material that can be engineered more accurately during manufacturing than those produced by conventional methods. It can thus provide the tennis ball with more specific flight and play characteristics whilst maintaining the optimum characteristics of stretch and flexibility for the manufacture of the ball.

This invention generates a tennis ball covering material having a felted outer surface with an appearance similar to conventional tennis ball material. The material, however, is manufactured in at least two parts. An outer layer which will eventually form the playing surface of the tennis ball; a backing, support layer which will form the surface to be bonded to the core of the tennis ball and, if required, an intermediate layer or number of intermediate layers. These multiple layers are then laminated together to form a single composite material which may itself be subjected to further finishing processes.

Each layer of the composite material so produced may be constructed using different textile manufacturing technologies and be composed of different fibres or blends of fibres and be of different weights, densities and have different physical characteristics.

Thus the outer layer material can be constructed to provide specific wear and performance characteristics appropriate for the tennis ball. It may be produced using woven or non-woven technology. The backing layer may also be produced using woven, non-woven or knitted technology and can be designed to meet the strength and deformation characteristics required for adhesion to the ball. Additionally, if required an intermediate layer or layers can be included to improve the bounce, spin or "feel" of the ball during play.

Further, it has now been discovered that a fabric having small indented areas (herein termed "dimples") are particularly suitable for the manufacture of tennis ball.

The present invention thus provides a fabric material for use as a sports ball covering, the fabric having a felted outer surface composed of entangled fibres, the outer surface being provided with a three dimensional pattern which comprises a series of dimpled areas, at least some of such dimpled areas each having a surface area ranging from about 3 to 150 $mm^2$, possibly 3 to 115 $mm^2$.

It is preferred that the fabric material be provided with a three-dimensional pattern, preferably a regular pattern, more preferably a pattern of regular dimples, on the outer surface.

Advantageously the pattern can be a pattern of dimples, preferably circular in shape. Alternative shapes of the indentations may be to between 30% and 70% of the full thickness of the fabric and each indentation may have a diameter of, at its widest part, between 2 mm and 12 mm, possibly between 2 mm and 5 mm.

Preferably the adjacent dimpled areas of the fabric material are separated by non-dimpled areas having a minimum width of from 50% to 300% of the diameter of the dimpled areas.

In one embodiment the fabric material may be a composite fabric comprising at least a backing or support layer and an outer layer. Optionally, if a dimpled surface is to be provided, the outer layer will have the pattern cut through it and will be affixed on the support layer to create said three dimensional pattern.

Advantageously, the backing layer constitutes between 40 and 70% of the weight of the composite fabric material. The backing layer may be a woven or a non-woven material. If the backing layer is a non-woven material it preferably includes a scrim.

It is further preferred that the outer layer be a needle felted fabric material.

It is further preferred that the outer layer and backing layer of the composite fabric material of the invention be affixed together using a needle felting technique. Alternatively, the layer of the composite fabric may be affixed together by ultrasonic bonding or thermal bonding (including the use of melt fibres, of scatter coating one fabric with a meltable powder, or of flame bonding).

The invention also relates to a method of manufacturing a composite fabric according to the invention as described above, such method including the steps of:

a) providing an outer layer optionally having a three-dimensional pattern cut therethrough;

b) providing a backing layer; and c) affixing the two layers together.

It is preferred that step c) be performed by needle punching the outer layer and the backing layer together.

A further object of the invention is the use of the fabric material of the invention to cover a tennis ball.

BRIEF DESCRIPTION OF THE DRAWINGS

Embodiments of the present invention will now be described, by the way of example only, with reference to the accompanying drawings in which.

DETAILED DESCRIPTION OF THE PREFERRED EMBODIMENTS

Figure 1:
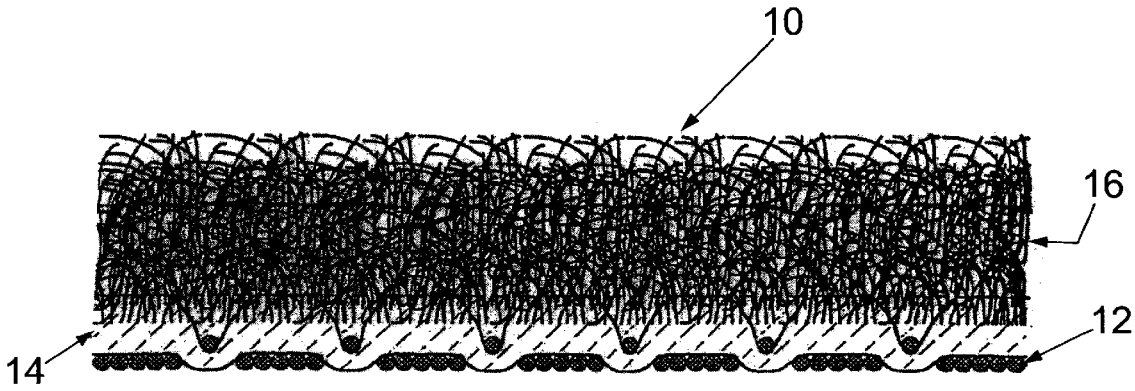
Fig. 1 (Prior Art)
FIG. 1 is a schematic cross-sectional view of a piece of a standard woven felt.

The material usually used to cover a tennis ball is a felted fabric which can be either non-woven or woven. However, woven felt like the one shown in FIG. 1 is preferred in order to achieve covering of a better quality and in particular wear-resistance. The standard woven felt 10 shown in FIG. 1 consists of a cotton warp yarn 12 and a wool/nylon weft yarn 14 which are woven together. An outer surface of entangled fibres 16 gives the fabric 10 a felted appearance. The felted surface 16 is the outer or playing surface, once the woven felt 10 is used to cover a tennis ball. In the fabric 10 each weft yarn 14 interlaces every six warp yarn 12. This frequency may vary from five to ten warp yarns or threads 12 and is typically seven.

Usually the overall thickness of a woven felt 10 as the one shown in FIG. 1 is uniform and typically between 2.5 and 3.8 mm. However the thickness depends on the end product style and the measurement method carried out.

Tennis balls can be made to curve in flight by imparting spin due to the physical phenomenon known as the "Magnus Effect". Air is a fluid medium. When a ball flies through the air its passage displaces the air but it also carries some air with it close to the surface of the ball. This is known as the "boundary layer". If the ball is spinning it imparts a spinning motion to the air in the boundary layer. The motion imparted to the boundary layer affects the way the air flow separates from the surface at the rear of the ball. Boundary layer separation is delayed on the side of the ball which is moving in the same direction as the free air flow, and occurs prematurely on the side moving against the free air flow. The turbulent wake of the ball is thus moved towards the side of the ball moving against the free air flow resulting in the flow past the ball being deflected and the resulting change momentum flux causes a force in the opposite direction.

Figure 2:
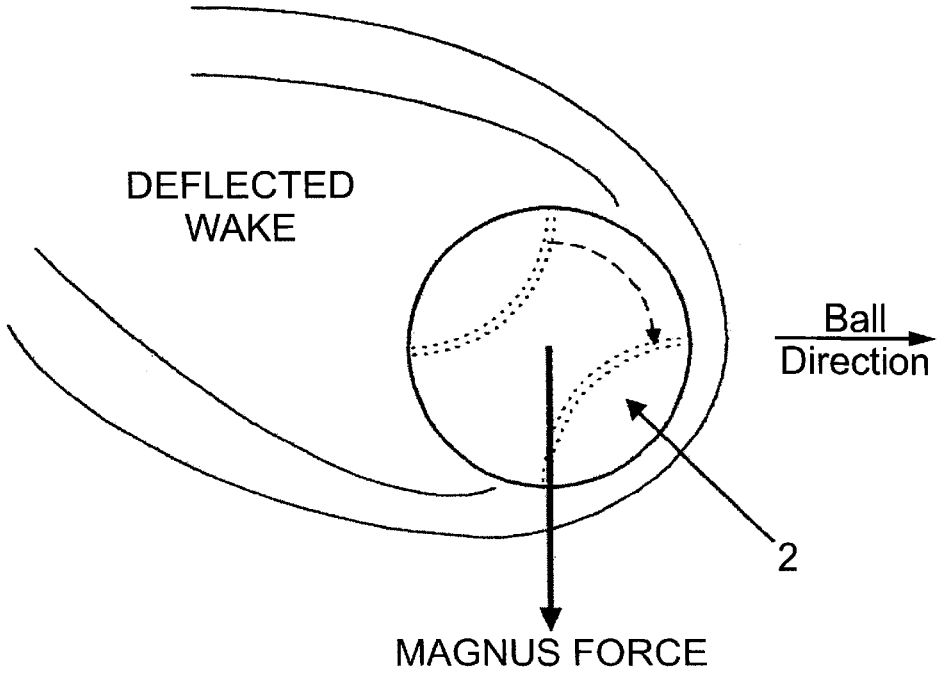
FIG. 2 is a schematic diagram representing a tennis ball travelling from left to right and showing the resultant Magnus force on the ball.

FIG. 2 is a schematic diagram representing a tennis ball 2 travelling from left to right and spinning in a clockwise direction and shows the resultant Magnus force on the ball 2. Thus, were this illustrating topspin, the ball 2 would be deflected downward by the Magnus Force.

The strength of the Magnus effect is in direct proportion to the rate of spin, the speed of the ball 2, the density of the air and the thickness of the boundary layer.

It is believed that a felted covering associated with the patterned surface of the tennis ball increases the thickness of the boundary layer around the ball and also helps to increase the friction between the racquet and the ball when the ball is struck. The combination of the thicker boundary layer together with the player's ability to impart increased spin due to better "grip" on the ball increases the Magnus Force and thus the degree of "curve" imparted to the ball.

Also the patterned ball surface increases the friction between the ball and the court surface reducing the tendency of the ball to slide along the court surface before rebounding thus enabling a player, by altering the angle of spin, to generate an increased "kick" off the court.

In addition, the patterned ball surface acts as a "cushion" between the racquet and the ball when the ball is struck reducing the shock of the ball impact on the player.

Figure 3:
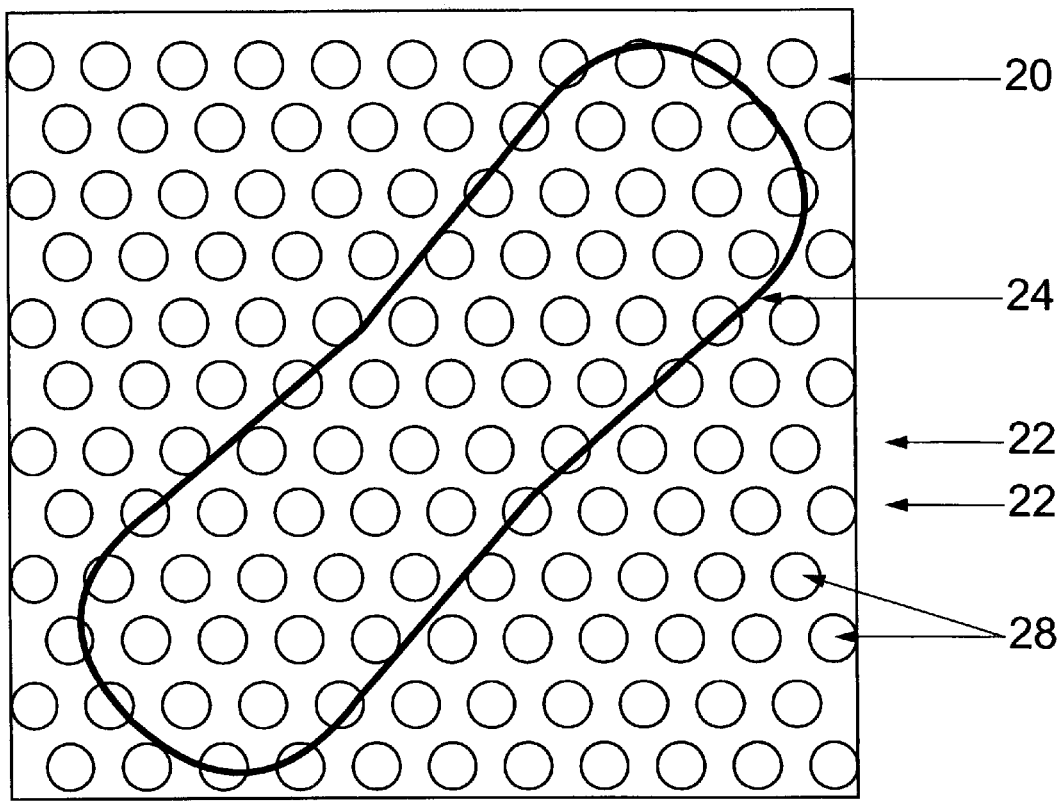
FIG. 3 is a schematic plan view of a first embodiment of a fabric according to the above-mentioned EP-A-0974378.
Figure 4:
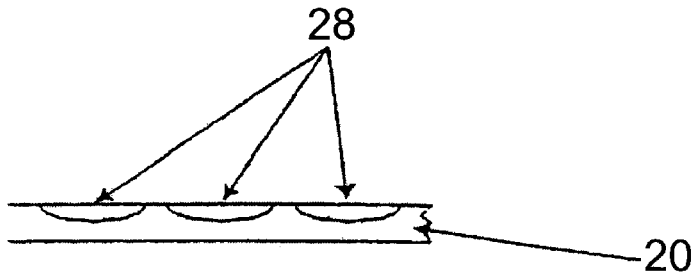
FIG. 4 is a partial cross-sectional view of the fabric of FIG. 3.

FIGS. 3 and 4 show a piece of fabric 20 according to a first embodiment proposed in EP-A-0974378 which, like the standard fabric 10, preferably comprises a cotton warp yarn 22 and a wool/nylon weft yarn 24 which are woven together. A surface of entangled fibres (not shown but of a structure similar to the one shown in FIG. 1) is present on the outer surface and gives to the fabric 20 a felted appearance. A series of depressions or dimples 28 are provided on the surface of the fabric. In FIG. 3 the dimples 28 are provided on the fabric regularly, and the felt 20 has a pattern of 10 mm circular dimples 28 at 12 mm centres. The dimples 28 are provided in parallel rows 22 and each row 22 is offset from the next by 6 mm. Such dimensions have been found to give to the ball particularly good properties but variations in these dimensions and other indentation patterns are not excluded. Possible methods of forming dimples 28 will be discussed below.

FIG. 4 shows a schematic cross section of the fabric 20 shown in FIG. 3 and the depressions in the surface. Such depressions are formed by the dimples 28 in the original piece of woven felt. At their deepest point, the dimples of FIGS. 3 and 4 are approximately 1.5 mm deep. The full thickness of the fabric 20 shown in FIGS. 3 and 4 is preferably about 3.5 mm.

Also clearly visible in FIG. 3 is the shape of a ball dumbbell 24 which is to be cut from the piece of woven felt 20, for eventually covering a tennis ball. Usually two pieces of this shape are needed in order to achieve total covering of a tennis ball. In this particular embodiment the distribution or pattern of dimples 28 on the ball is overall irregular.

The fabric proposed can be made according to known techniques in the art. However the following techniques are much preferred as they give fabrics particular characteristics, such as feel and resistance to wear.

Figure 5:
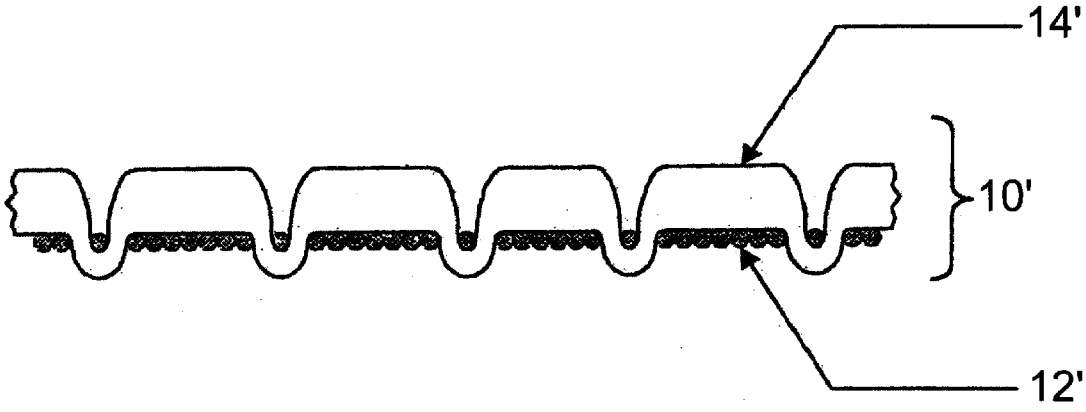
Fig. 5 (Prior Art)
FIG. 5 is a schematic cross-sectional view of a portion of the interlacing of the weft and warp threads in a standard woven fabric used for tennis ball covering.

FIG. 1 shows a standard woven felt fabric 10 used to cover a tennis ball. FIG. 5 shows another standard woven felt fabric 10' used for covering a tennis ball wherein the finishing process of raising and milling has not been carried out yet and no felted layer is present. As shown in FIGS. 1 and 5 the standard woven felt fabric 10 or 10' used for a tennis ball usually uses a "sateen" weave or modification thereof. With this form of weave long "floats" of woolen spun weft yarn 14 or 14' are produced. Typically these weft threads 14 or 14' may "float" over warp threads 12 or 12' interfacing with only one warp thread 12 or 12' in six (like the fabric 10 shown in FIG. 1) or in eight (like the fabric 10' shown in FIG. 6). Using this form of construction the weft threads 14 or 14' lie predominantly to one side of the fabric 10 or 10' and eventually form the outer surface of the fabric 10 or 10' and thus the outer (playing) surface of the tennis ball. Thus, weft threads 14 or 14' lie predominantly on the outer surface of the fabric 10 or 10' and the warp threads 12 or 12' predominantly on the back. Each weft thread 14' is interlaced with different warp threads 12' until a pattern repeat is achieved. Then, raising and milling steps are performed to "finish" the fabric 10 and 10' and gives it the felted cover 16 (not shown in FIG. 5).

Figure 6:
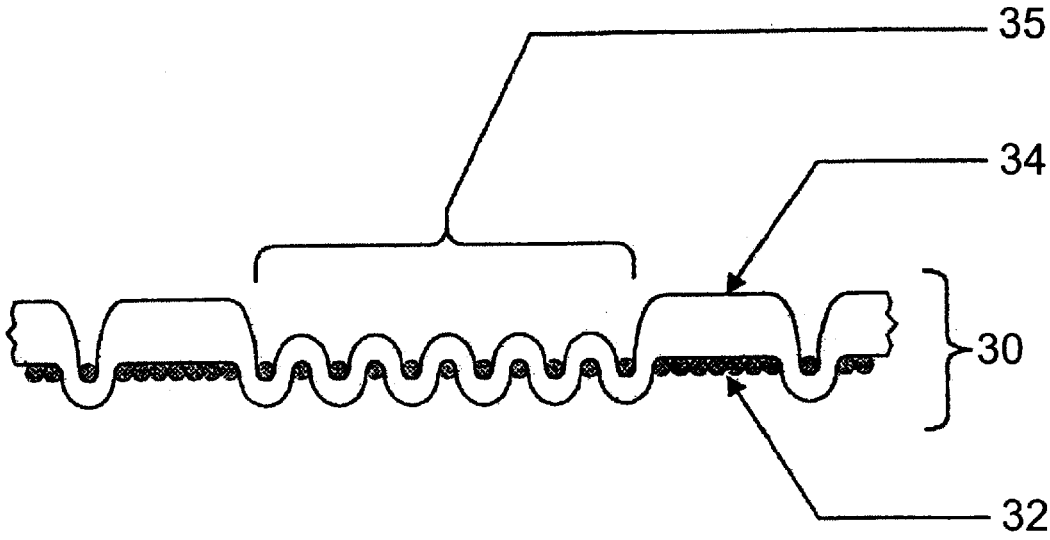
FIG. 6 is a schematic cross-sectional view of a portion of the interlacing of the weft and warp threads in a woven fabric made according to a second embodiment proposed in EP-A-0974378.
Figure 7:
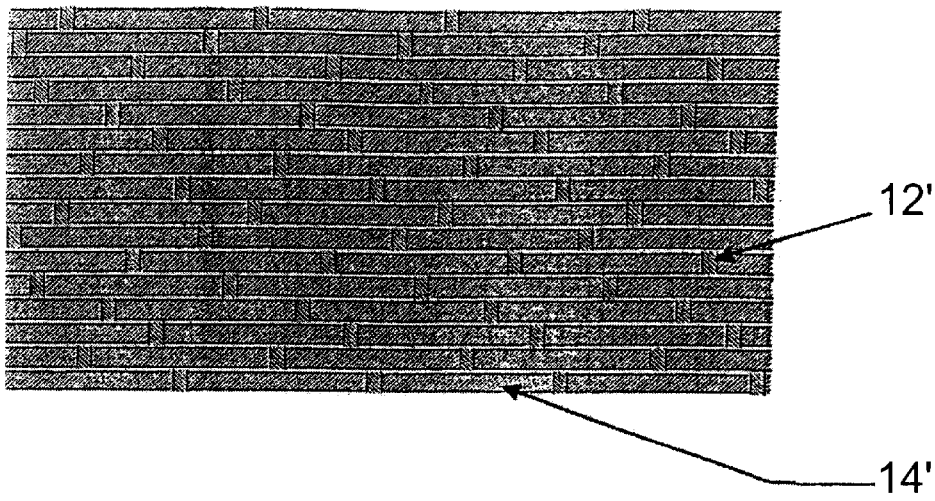
Fig. 7 (Prior Art)
FIG. 7 is a schematic plan view of the interlacing of the weft and warp threads in the standard woven fabric shown in FIG. 5.

FIG. 7 illustrates a typical design structure of the woven tennis ball felt fabric 10' shown in FIG. 6 when viewed from the top surface. Weft threads 14' 'float' over the warp threads 12' interfacing with every eighth warp thread 12'. In this case the interlacings of the threads 12' and 14' form a conventional herringbone pattern.

In the second embodiment described in EP-A-0,974,378, a three dimensional pattern in a tennis ball woven felt is produced by modifying the woven construction of a conventional woven felt to generate areas of tighter yarn interlacing compared to the remaining area or ground of the fabric. By modifying the construction of the fabric during weaving it is possible to create areas where the warp and weft threads interlace more frequently. The increased level of interlacing causes the threads in this area to be held together more tightly and the weft threads are prevented from bulking up during subsequent "finishing" processes. The difference of thickness between the depressions and the remaining part of the fabric is therefore accentuated. Thus the areas of tighter interlacing are thinner than the ground of the fabric creating a three-dimensional pattern in the surface of the fabric.

FIG. 6 is a schematic cross-sectional diagram of a portion of a woven patterned felt fabric 30 according to the second embodiment of EP-A-0974378 showing an indented area 35 where the weft thread 34 is interlaced alternately with each warp thread 32. In so doing the weft thread 34 is held more tightly into the ground of the fabric 30 in this section creating a three dimensional pattern or indentation 35 in the surface. The difference between the ground and the indentation 35 is usually exaggerated during the finishing processes (raising and milling steps) to produce the desired characteristics.

Figure 8:
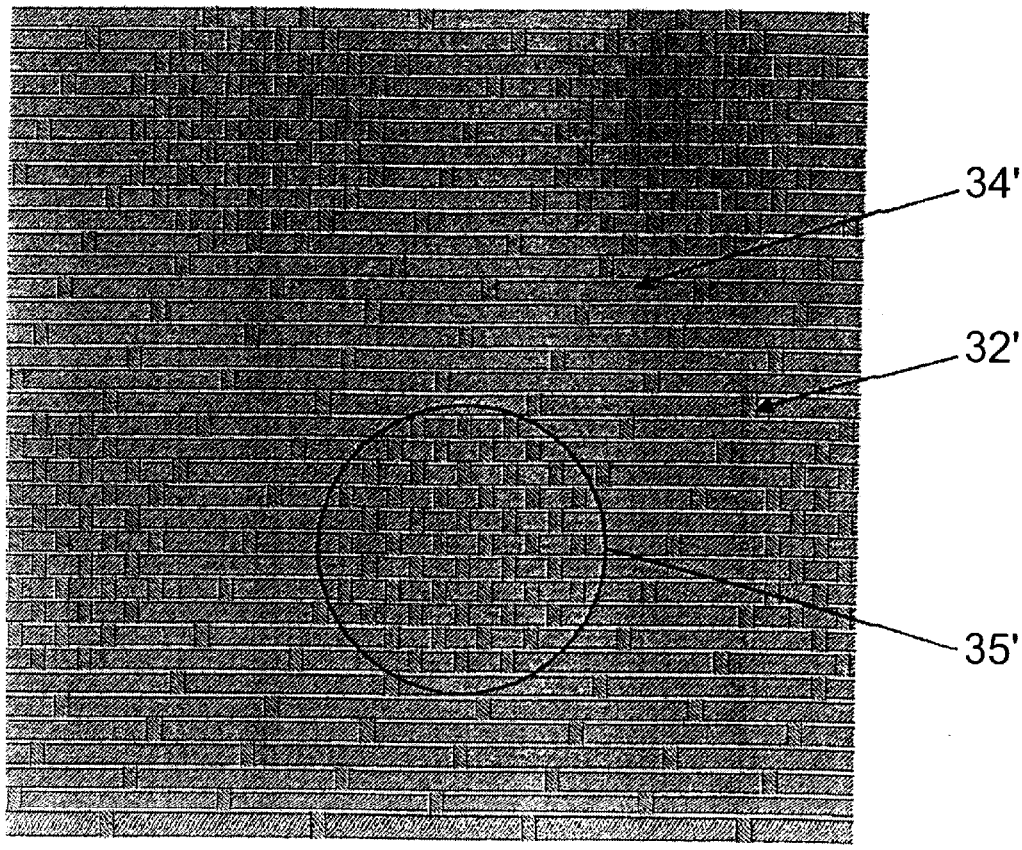
FIG. 8 is a schematic plan view of a portion of the interlacing of the weft and warp threads in a woven fabric similar to the one shown in FIG. 6.

FIG. 8 illustrates an enlargement of the appearance of the woven patterned tennis ball felt fabric 30' similar to the one shown in FIG. 6 viewed from the top surface. In this fabric 30' the "ground" of the fabric 30' is shown with the weft threads 34' "floating" over the warp thread 32' and interlacing, in this example, with the warp threads 32' at intervals of nine threads 32'. Also visible are areas of "plain" weave 35' where the warp thread 32' interlaces each weft thread 34' alternately creating a more heavily interlaced "motif" 35'. The fabric of FIG. 6 differs from the fabric of FIG. 8 only by the fact that in FIG. 6 the weft thread 34 interlace warp thread 32 at an interval of eight threads 32 instead of nine as in FIG. 8.

FIGS. 6 and 8 show that in these example the pattern is predominantly one of circular indentations 35 and 35'. When woven at 10 warp threads per centimeter and 13.4 weft threads per centimeter the fabric 30' shown in FIG. 8 gives, due to weft way shrinkage during the finishing process, an indented "motif" of approximately 0.75 centimeters diameter in the finished felt with a spacing of 5 to 7 mm of normal felt between each indentation. However, by altering the layout of the interfacings it is possible, if required, to alter the shape and/or size of the motif.

Also by altering the frequency of the interfacings (i.e. the length of the "float") in either or both the motif and the ground structure it is possible to alter the intensity of the motif, that is the degree of difference in definition and appearance between the ground of the cloth and the motif and thus the flight characteristic of the resultant ball. The fabric 30' may have a pattern of 7 mm circular indentations at 12 mm centres. The indentations 35' are provided in parallel rows each row offset from the next by 6 mm. At their deepest point, the dimples may be approximately 1.5 mm deep. The full felt thickness may be 3.5 mm deep.

It can therefore be seen that using the above process a three dimensional pattern similar to the one shown in FIG. 3 may be obtained although a wide variety of three dimensional patterns can be achieved by modifying the motif and ground combinations either by adjustment of the ground/motif interlacings and/or by adjustment of the size, shape and frequency of the motif. It can also be seen that by inverting the interlacings of the ground and motif the motif can be produced to form a raised pattern compared with the ground.

All these pattern variations will have, to a greater or lesser extent, an influence on the flight character of the ball when spin is imparted by the player.

An alternative method of producing a patterned tennis ball felt according a third embodiment described in EP-A-0,974,378 is to apply a patterned needling technique either to a standard woven felt or to a felt made by non-woven technologies which is acceptable for tennis ball covering. The method is applied either after completing, or part way through, the conventional tennis felt manufacturing process. A sheet of such felt is passed through a needlefelting machine, i.e. a needleloom, which contains a reciprocating board. The board extends across the full width of the felt and is set with barbed or forked needles which project from the board in a specific pattern. As the needleboard reciprocates the needles penetrate the felt catching fibres or small clumps of fibre and pushing them into the body of the felt. This causes increased fibre entanglement and felt consolidation at the pint of impact. When the needles are withdrawn the felt is drawn forward so the next penetration of the needle is offset from the previous penetration. The steps are repeated as required to create the desired pattern of indentations in the felt.

The needleboard is then raised clear of the felt which is then drawn through the machine a specific distance before the cycle is repeated.

Figure 9:
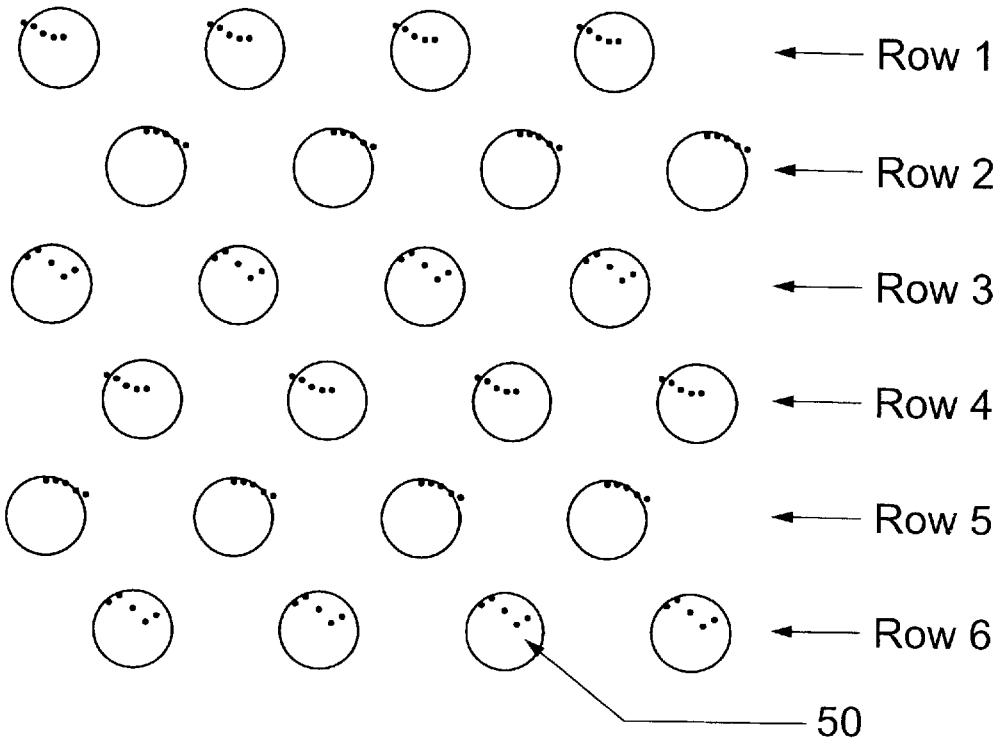
FIG. 9 is a schematic view of a needleboard layout set up of a needleboard machine which may be used to produce a fabric according to a third embodiment proposed in the above-mentioned EP-A-0974378.

FIG. 9 shows a possible needleboard layout set up to produce a pattern of circular indentations similar to the one shown in FIG. 3. The needles 50 (which are represented as small black dots) are set in a pattern which repeats over 6 rows. Rows 1, 2 and 3 each have a different configuration of needles 50. This configuration is then repeated in rows 4, 5 and 6 with the needle pattern in each row being offset one place. After each needling cycle the needles are withdrawn and the felt drawn forward through two rows. Thus, the needled pattern from row 1 has the pattern from row 3 and then row 5 superimposed. The pattern from row 2 has the pattern from row 4 and row 6 superimposed. The needle patterns from rows 1, 3 and 5 or rows 2, 4 and 6 combine to produce the desired symmetrical indentation or "dimple" in the felt, each indentation having been produced by a total of 15 needles 50. It is desirable that the process be repeated several times by following groups of 6 needle rows which repeat the process and reinforce the effect produced by the groups before them.

Figure 10:
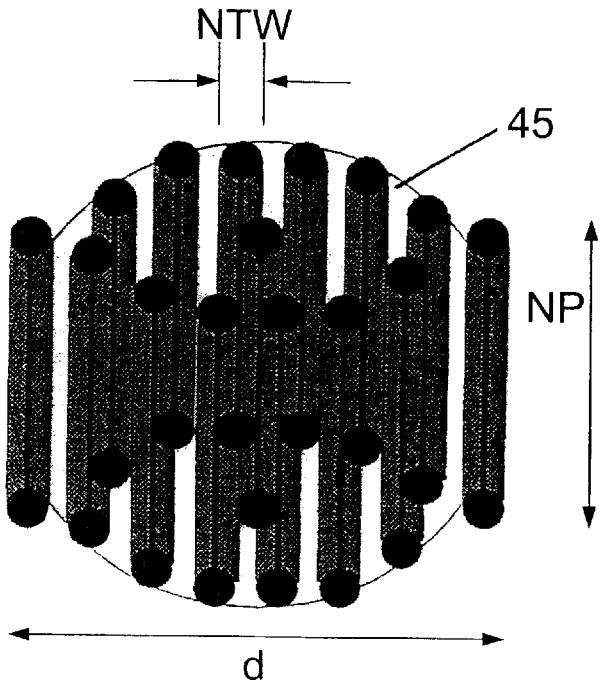
FIG. 10 is a schematic representation of the needling pattern of a single indentation after a needling cycle following the set up shown in FIG. 9 has been completed.

FIG. 10 is a schematic showing the needling pattern of a single indentation 45 after the 3 rows needling cycle has been completed. As shown in FIG. 10, after the first needling cycle this indentation 45 will constitute in a series of vertical depressed lines. However, successive cycles will give to the indentation 45 the general "dimpled" pattern. In FIG. 10 "d"

is the general diameter of the depression 45; "NP" is the Needle Path length covered by each needle 50; "NTW" is Needle Tracking Width or the width of the depression created by each needle 50 during its cycle.

The patterns achieved using needling techniques are not as clearly defined as those produced using a modified woven construction and, to obtain more acceptable results, it is advisable to shear the back of the felt very severely to remove the excess fibres driven through the back of the felt by the action of the needles.

In another alternative, protuberances instead of depressions may be formed on the playing surface of the felt by processing the felt through the patterned needling machine from the back side. This could be a modification of the needling process already described.

A further alternative method of producing a patterned tennis ball felt is described as follows. This method is appropriate for producing patterned felt using non-woven technology. With this method two separate layers of standard needle felt material are produced and subsequently needled together.

Preferably, one, the bottom layer, contains a support scrim, while the second, top or outer layer, contains no scrim. Each layer can be structured for fibre content, weight and needling density to optimise the end product performance.

Preferably, the bottom layer, including the scrim, will constitute between 40% and 70% by weight of the material.

Preferably the scrim will be warp knitted from polyamide or polyester filament yarn.

After pre-needling the top layer is processed through a stamping or die-cutting machine which punches out sections of material in a pre-determined pattern forming a punched fibre matrix. The hole size, shape and pattern punched out can be altered according to the requirements for the finished material.

Preferably the punched holes are circular in shape with a diameter of between 5 mm and 20 mm.

Preferably the holes are punched in a regular pattern.

Preferably the holes so punched are separated by material with a width of between 50% and 150% of the diameter of the holes.

Figure 11:
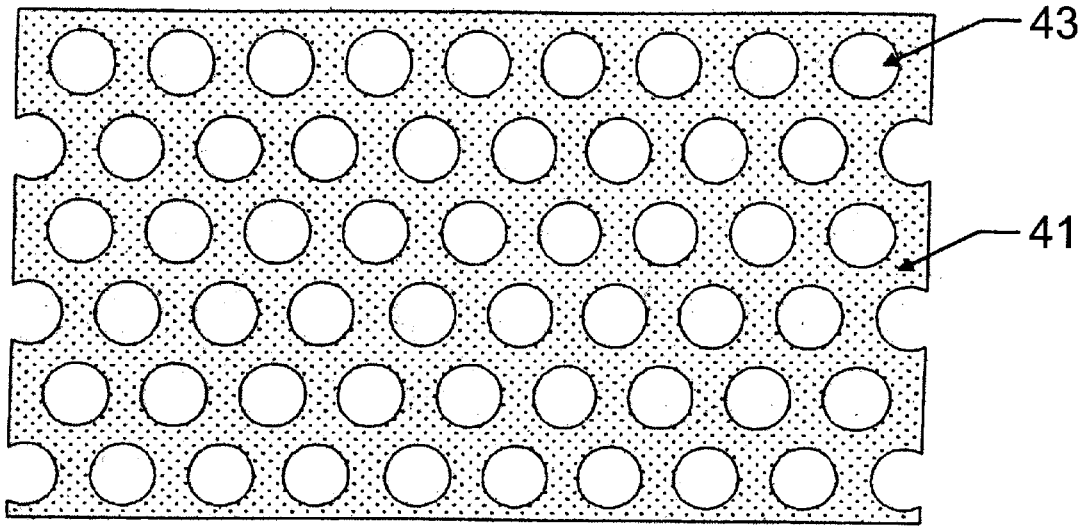
FIG. 11 is a schematic plan view of an outer layer of fabric used to make a fabric for covering a tennis ball according to a fourth embodiment proposed in the above-mentioned EP-A-0974378.

FIG. 11 shows a view of a possible punched piece of pre-needled top layer of a felted fabric 41, advantageously a felt described in EP-A-0,974,378. In this case the felt 41 has a pattern of 10 mm circular holes 43 punched from it at 15 mm centres. The holes 43 are set in parallel rows each row offset by 7.5 mm. The overall appearance of the fabric 40 is similar to the one shown in FIG. 3. Obviously, in other embodiments these dimensions will vary depending on the desired hole shape and pattern. The two layers of felt, the bottom layer containing the scrim and the top layer containing the punched holes, are then needled together to form a single composite material.

Figure 12:
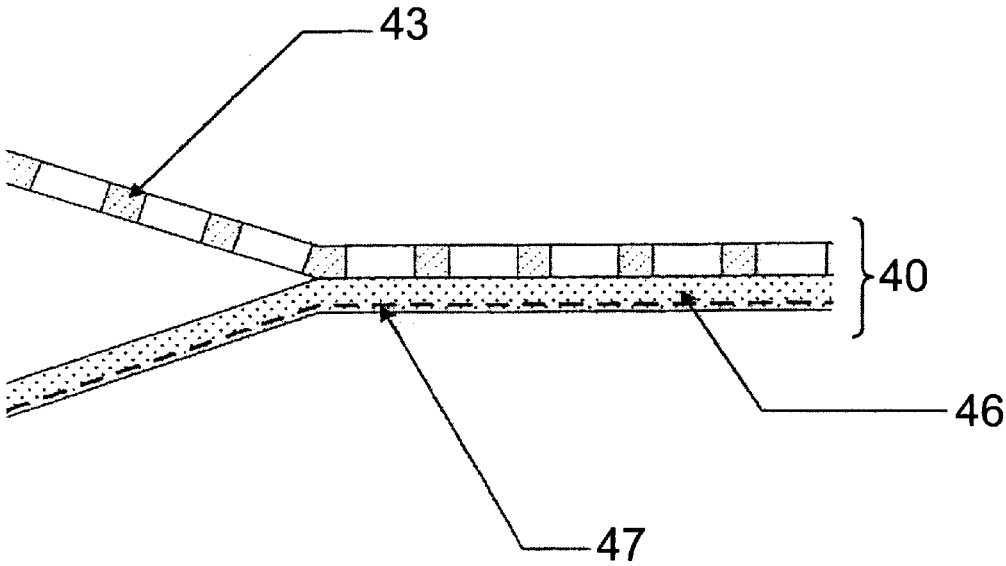
FIG. 12 is a schematic representation of the two layers of fabric used to make a sheet of fabric for covering a tennis ball according to a fifth embodiment proposed in the above-mentioned EP-A-0974378 being brought together to form said fabric for covering tennis ball.

FIG. 12 shows a cross sectional representation of the two layers of pre-needled felt being brought together to form the composite fabric 40. The outer layer 41 is punched with holes 43. The bottom layer 46 contains the scrim 47.

The composite needled fabric 40 may, if required, be subjected to finishing processes to enhance the aesthetic and wear characteristics of the felt and ball.

A further possibility would be to pass a piece of felt through a conventional Calendering Machine. This would involve passing the felt between heated rolls under pressure. The roll pressing on the top (i.e. playing) surface of the felt would have a embossed pattern which would be a "negative" of that required for the felt. The pressure and heat applied would compress the felt and set it into the desired pattern.

According to another possibility, the dimples may be provided using conventional textile patterning techniques. For example, the textile patterning process described in U.S. Pat. No. 5,404,626 (known as the MILLITEX process) may be used. However these two last methods (i.e. the Millitex process and the compression process) are less preferred.

Figure 13:
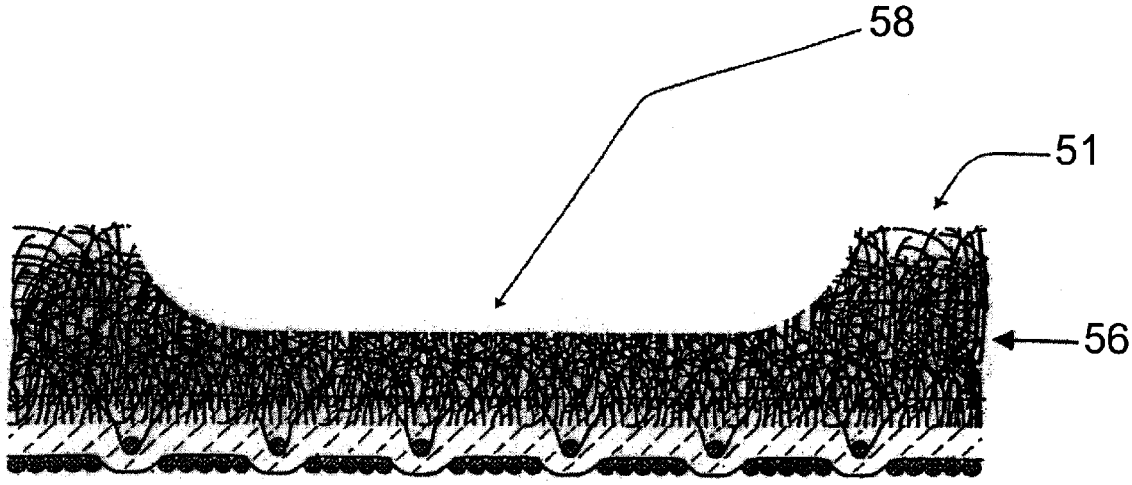
FIG. 13 is a schematic cross-sectional view of a fabric proposed in the above-mentioned EP-A-0974378 and showing the general profile of a dimple.

FIG. 13 represents a cross-sectional schematic view of a woven fabric 50 made proposed in EP-A-0,974,378 having the preferred circular dimples 58 in the felted layer 56. FIG. 13 aims to represent the general profile of such dimples 58. The actual structure of the fabric 50, and especially the felted layer 56, may vary depending of the method used to manufacture it.

The new fabric described hereinbelow is an improvement of one of the fabrics described in EP-A-0,974,378. The new fabric has a felted outer surface composed of entangled fibres and provided with a three dimensional pattern thereon comprising a series of dimpled and non-dimpled areas. It has been found surprisingly that a fabric having dimpled areas each presenting an average surface area ranging from about 3 to 150 $mm^2$ is much more desirable for use as a tennis ball covering.

A preferred embodiment of the invention is a fabric which comprises two distinct layers, it is also preferred that the composite material comprises at least a backing or support layer and an outer layer, the outer layer having the pattern cut through it and being affixed on the support layer to create said three dimensional pattern.

The outer layer material can be produced from a range of raw materials using a variety of textile manufacturing techniques. Preferably the outer layer material is produced using a fibre blend containing a proportion of wool fibre. Other fibres may be used or blended with the wool fibres. Good results have been obtained using a blend composed of 50% wool fibres and 50% polyamide fibres. Use of wool fibres are indeed preferred as they contribute well to the "handle" and appearance of the end product whilst the polyamide fibres enhance the durability in play. A mixture of wool and polyamide fibres is further advantageous as these two types of fibre can be dyed together using the same class of dyestuff. The selection of fibre diameter and length will depend on the required characteristics of the end product. Good results have been obtained using wool fibres of 35 to 40 microns diameter and a length of between 50 and 100 mm and synthetic fibres of 6.7 to 13 decitex sizes and a length of between 50 and 100 mm.

The outer layer material may be a woven or non-woven textile. Preferably the outer layer material is needlefelted using needlefelting technology. This manufacturing method can produce felt of consistent weight and thickness from both wool and synthetic fibres. The selected fibres are blended together, carded and cross-lapped before feeding to the needling machine. Advantageously a double doffing card is used to reduce web weight variation and improve the weight consistency of the batt of fibres presented to the needlefelting machine. Also the use of a cross-lapping machine with profiling capability improves weight consistency. Conventional needling machines can be used but it is preferred to use machines incorporating the Fehrer H1 curved needle board technology. These machines provide the capability of penetrating the fabric with needles at angles which are additionally non-perpendicular with respect to the plane of the fabric thus generating increased fibre entanglement for a given punch density over that of a conventional machine. The selection of needles and machine settings for the needlefelting machine depends on the characteristics required for the outer layer and raw materials selected. Typically the felt is produced using a pre-needling machine followed by a finish-needling machine. The latter advantageously contains two needle boards one each in down-punch and up-punch configuration which enable needlefelting to proceed from both sides of the felt in a single pass.

The weight and thickness of the needlefelted outer layer depends on a variety of influencing factors. These include:

a) the required weight and thickness of the end product;
b) the thickness of the backing layer; and
c) the reduction in thickness of the material during laminating and any subsequent dyeing and finishing processes.

A typical conventional tennis ball covering material will weigh between 650 and 800 grams per square meter and will have a thickness of between 2.5 and 3.8 mm. The weight and thickness of the end product is further influenced by the ball core weight and size coupled with the required ball performance. All competition tennis balls must fall within the International Tennis Federation specification for weight and size. Thus, the outer layer can be structured for fibre content, weight and needling density to optimise the end product.

After production through the needlefelting line the outer layer material is processed through equipment to cut, stamp or punch sections of the material in a pre-determined pattern generating a series of holes through the thickness of the material. The areas of these holes ranges between about 3 and 150 $mm^2$ or even 115 $mm^2$. The specific size, shape and pattern of the holes so punched can be altered according to the requirements for the finished material. Good results have been achieved using circular holes of a diameter ranging between 2 mm and 12 mm. Good results have also been obtained using die cutting equipment but other methods such as ultrasonic cutting or laser cutting may alternatively be employed.

Figure 14:
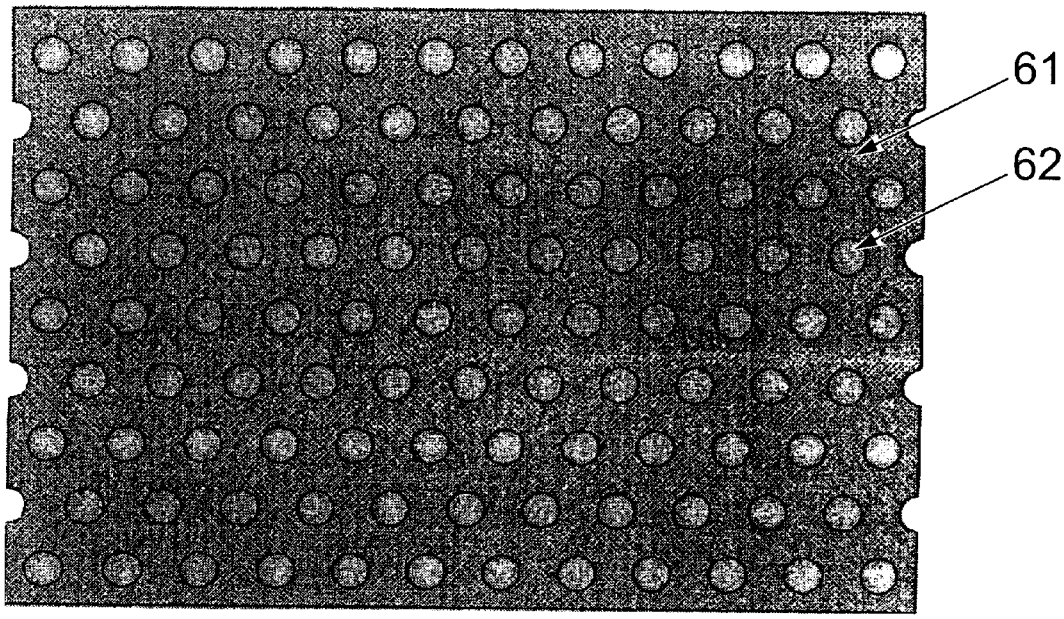
FIG. 14 is a schematic plan view of an outer layer of fabric used to make a composite fabric material according to a preferred embodiment of the invention.

FIG. 14 shows a perforated outer layer 61 used in the preferred embodiment of the invention. The outer layer 61 has a pattern of 4 mm diameter circular holes 62. The holes 62 are formed by removing circular portions from the outer layer at 8 mm centres leaving 4 mm of felt between each hole 62. The holes 62 are set in parallel rows each row 7 mm from the next with the holes offset by 4 mm. Obviously other hole distribution patterns and shapes are possible.

Typically an outer layer felt weight after hole cutting of between 250 and 350 grams per square meter give a good result. The weight loss due to hole cutting will depend on the hole size and distribution plus any losses incurred due to processing and is likely to reduce the felt weight by between 15% and 30%. Thus, the target weight for the needlefelted outer layer before hole cutting can vary considerably, but is typically ranging between 300 and 500 grams per square meter.

The backing layer can be produced from a range of raw materials using a variety of textile manufacturing techniques. Preferably the backing layer is produced from a woven material, or weft-inserted warp knit material. Advantageously the woven design provides for the weft yarns to be predominantly on one side of the material and the warp yarns to be predominantly on the opposite side of the material. The preferred woven design is of a weft-faced sateen or broken crow construction.

Figure 15:
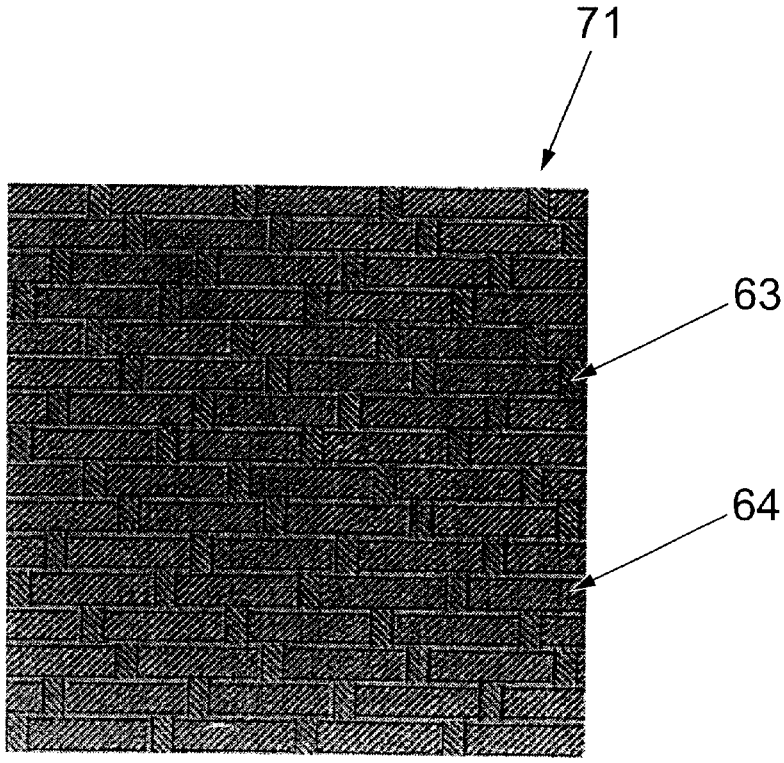
FIG. 15 is a schematic enlarged representation of the woven pattern of a backing layer used to make a composite fabric material according a preferred embodiment of the invention.

FIG. 15 shows the construction of a broken crow weave repeating on 4 warp ends and 4 weft picks of a woven backing layer 71 use in the manufacture of the preferred embodiment of the invention. Each warp end 63 passes over one weft pick 64 and under 3 weft picks 64 in each of the repeat design. Thus, in this construction, the warp threads 63 lie predominantly on the back of the backing layer 71 which is the side that will be bonded to the ball core and the weft threads 64 lie predominantly on the surface which will be laminated to the needlefelted outer layer 61.

Since the weft threads 64 of the backing layer 71 are to be bonded to the fibres of the outer layer 61 it is advantageous that they are mutually compatible. A proportion of wool fibres is usefully incorporated into the weft yarn blend. The presence of wool fibres allows the backing layer 71 material to be shrunk and felted in a milling process which increases the consolidation and density of the material. A woollen spun weft yarn 64 produced from a blend of 60% wool fibres and 40% polyamide staple fibres has given good results.

The fibre diameter and length depend on the required characteristics of the end product. Good results have been obtained using wool fibres of 35 to 40 microns diameter and a length of between 50 and 100 mm and synthetic fibres of 6.7 to 13 decitex sizes and a length of between 50 and 100 mm.

Weft yarn size, twist and yarn processing parameters depends on a range of factors. For example a strong, twisted yarn is desirable to increase weaving capabilities but a soft spun yarn is also desirable to produce a better end product.

The warp threads 63 of the backing layer 71 material form a surface to be bonded to the tennis ball core. For this reason, cotton or polyamide yarns are preferred. The synthetic fibre yarn may be produced from staple fibres or filaments, which are then texturised. The yarn size and strength must be adequate to support the material during processing and ball manufacturing. Two-ply cotton spun yarn of 2/20's or 2/28's size gives good results.

After weaving, the backing layer 71 material is advantageously subjected to a series of finishing processes. In the first of these the fabric is washed or scoured to remove incidental dirt and any lubricants or contaminants applied to facilitate yarn manufacture or weaving. Scouring techniques are well known in the art and need not be described further.

If the weft yarn 64 of the backing layer 71 contains a proportion of wool fibres it can at this stage be subjected to a woollen milling or fulling process. In this process the material is exposed to mechanical pressure in the presence of moisture and heat. Wool fibres, due to their characteristic scale structure, will matt together under these conditions shrinking the fabric to form a more entangled and consolidated felt. Weft way shrinkage of 20% to 35% can be expected generating a well-felted surface in the weft yarn. Milling techniques are well known in the art and need not be described further.

Following milling and depending on the appearance and consolidation of the surface fibres the backing layer 71 may be subjected to a raising or brushing process.

In this process, if required, the surface of the material is subjected to the mechanical action of a number of rollers covered with wire or abrasive material. These rollers brush across the surface of the material lifting individual fibres from the entangled mass and forming an even surface or "nap".

The weight and thickness of the backing layer 71 depends on a variety of influencing factors. These include:

a) the weight and thickness required for the end product;
b) the weight and thickness of the outer layer; and
c) the weight losses and reduction in thickness incurred during laminating and any subsequent dyeing and finishing processes.

Advantageously, the backing layer consists between 40 and 70% of the total weight of the resulting composite fabric.

The outer layer 61 and the backing layer 71 so produced are attached or laminated together to form a single, composite fabric. Preferably, this is achieved by passing the two layers 61 and 71 together through a needlefelting machine which contains two reciprocating needle boards.

Figure 16:
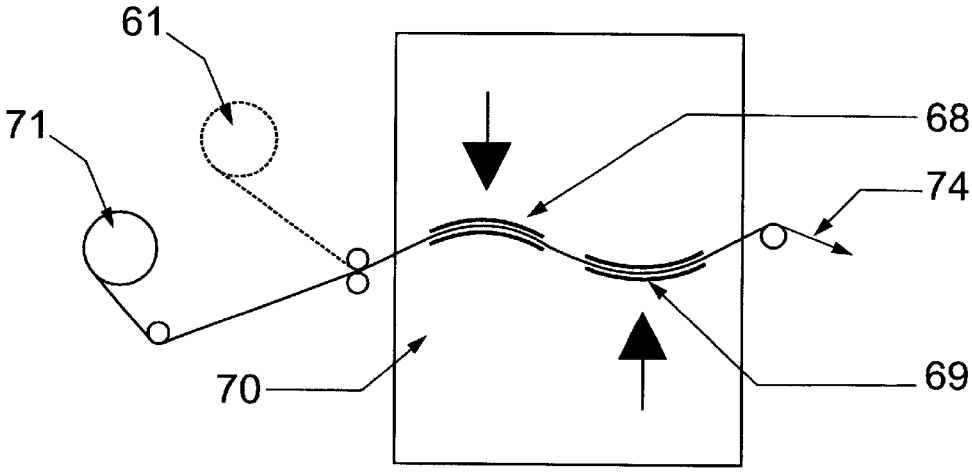
FIG. 16 is a schematic representation of a layer of fabric being processed through the needle board of a needlefelting machine used in a preferred embodiment of the method of the invention.

FIG. 16 shows a schematic representation of the needleboards of a needlefelting machine 70 fitted with down-punch 68 and up-punch 69 needle boards.

Advantageously but not essentially, these boards 68 & 69 may incorporate the Fehrer H1 curved needle board technology described above. The backing layer 71 and outer layer 61 are processed through the needlefelting machine 70 where the action of the barbed reciprocating needles drives fibres from one layer through the outer layer causes them to be linked together forming a single composite material 74.

As shown in FIG. 16 the first down-punch needle board 68 pushes fibres from the outer, perforated layer 61 into the backing layer 71. The second up-punch needle board 69 pushes fibres from the woven backing layer 71 into the perforated outer layer 61. In so doing, it also returns a proportion of the previously punched fibres back into the outer layer 61 thus increasing fibre entanglement.

Needle specification, penetration and punch density will depend on the machine, the materials used and end product performance. Good results have been obtained with a specification similar to the one used for needlefelting the outer layer.

It is important that fibre entanglement be sufficient to ensure no risk of the felt delaminating during subsequent processing, tennis ball manufacture or in play.

Figure 17:
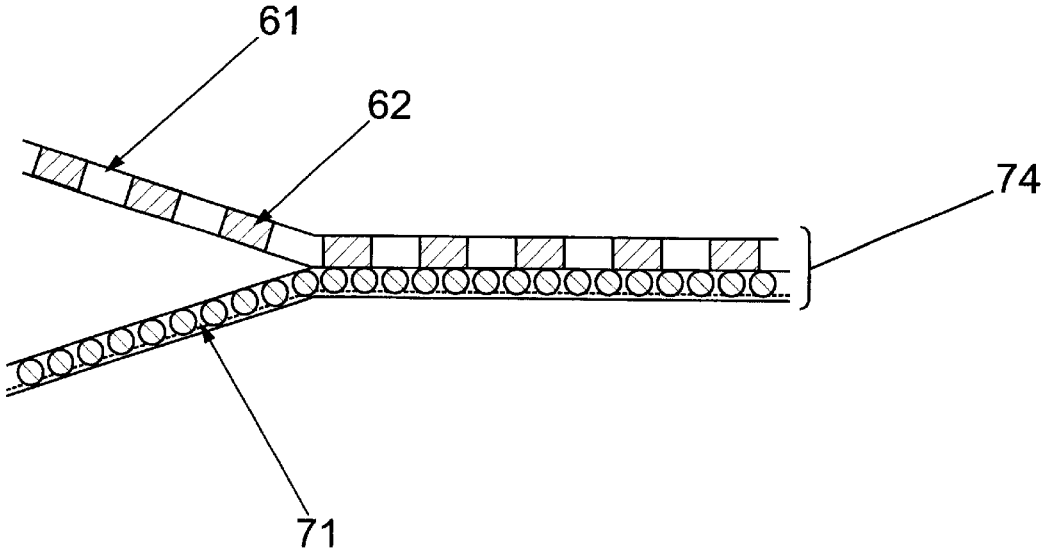
FIG. 17 is a schematic diagram of the outer and backing layers being joined together prior to needlefelting in order to form the composite fabric material according to a preferred method of manufacturing the invention.

FIG. 17 shows a schematic diagram of the outer layer 61 containing regular perforations 62 joining with the backing layer material 71 to form the resultant composite material 74.

Figure 18:
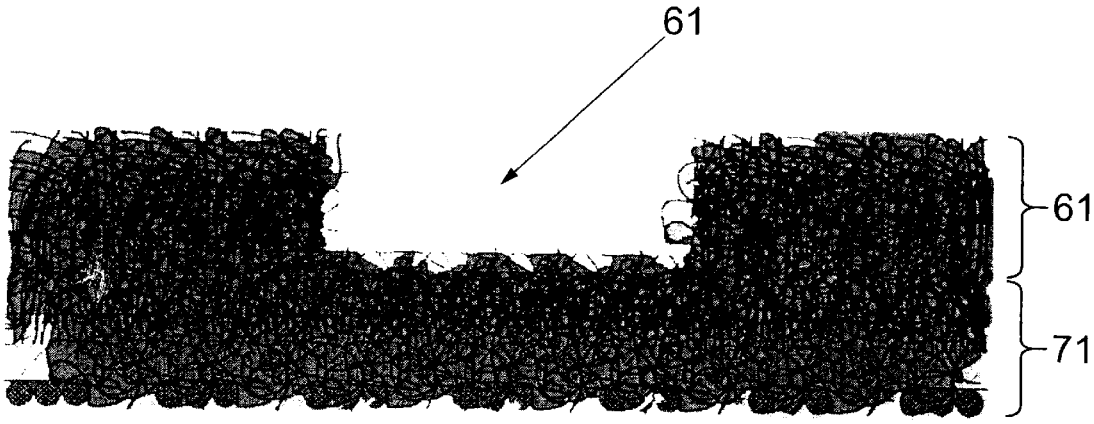
FIG. 18 shows a schematic diagram of a greatly enlarged cross section of a portion of the resultant composite material according to the preferred embodiment of the invention.

FIG. 18 shows a schematic diagram of a greatly enlarged cross section of a portion of the resultant laminated felt. The outer layer 61 containing a punched hole 62 is firmly attached to the woven backing material 71 by the entanglement of their respective fibres.

Conventional materials for covering tennis balls are usually dyed to a fluorescent yellow colour. The material produced can be so dyed using a variety of piece dyeing equipment like winch beck or jet dyeing techniques.

Alternatively, novel effects can be produced by dyeing fibres, yarn or layer fabrics separately to different colours. For example, a ball with a darker coloured pattern of indentations can be produced by dyeing the backing layer material to a darker colour than the outer layer material before the two materials are laminated together.

It usually desirable to apply one or more of a range of finishing techniques to the laminated felt. For example, the dyed and dried material may benefit from a shearing or cropping process to remove any extraneous surface fibres from either and/or the face and back surface of the material. This usually improves the appearance of the product and could provide a cleaner back surface for the application of adhesive during ball manufacture.

It also may be appropriate to provide an additional milling process after laminating to further consolidate the material and improve the fibrous bond between the outer layer and the backing layer.

Additional chemical treatments could, if required, also be applied. For example, a water-resistant chemical could be impregnated into the felt.

Woven felt produced as described above thus can be used by the ball manufacturer without any significant modification to the covering process. The back side of the fabric is smooth enough to be coated with adhesive in the conventional manner and dumbbell shapes, when cut, can be fitted to the ball core using standard semi-automatic covering equipment.

Tennis balls made using the textile of the present invention have significant advantages over known tennis balls, for example because of the improved flight characteristics. Tennis players can exercise a far greater degree of control over the ball, and hence their game.

An alternative embodiment of this invention is a material to cover tennis ball specifically adapted for use on indoor carpet courts. Such balls are considered to have different felt wearing requirements to that used on abrasive outdoor courts. Balls used on indoor carpet courts are not subjected to high abrasive wear but repeated impacts with the court surface make them more prone to "fluffing up" during play. For this end use, it could be advantageous to produce a thinner outer layer material containing a higher proportion of possibly finer wool fibres with an increased density of needling. Thus, it can be seen that modifications can be made to the foregoing without departing from the scope of the invention.

What is claimed is:

1. A composite fabric material for use in covering sports balls, the composite fabric material comprising two or more separate fabric materials affixed together to form a single material, the composite material including at least an outer layer and a backing or support layer, wherein the composite material has a three-dimensional pattern on its outer surface, and the pattern is cut through the outer layer prior to affixation with the backing or support layer.

2. A composite material as claimed in claim 1 which includes one or more intermediate layers.

3. A composite material as claimed in claim 1 wherein the outer layer material is a fibre blend containing a proportion of wool fibre.

4. A composite material as claimed in claim 3 wherein the outer layer material is a blend of 50% wool fibres and 50% polyamide fibres.

5. A composite material as claimed in claim 3 wherein the wool fibres have a 30 to 40 microns diameter and a length of between 50 and 100 mm, and the outer layer contains a proportion of synthetic fibres, the synthetic fibres having 6.7 to 13 decitex sizes and a length of between 50 and 100 mm.

6. A composite material as claimed in claim 1 wherein the outer layer material is needlefelted.

7. A composite material as claimed in claim 1 wherein the backing or support layer comprises between 40% and 70% of the weight of the composite fabric material.

8. A composite material as claimed in claim 1 in which the backing layer includes a scrim.

9. A composite material as claimed in claim 1 in which the outer layer and backing or support layer are affixed together by needlefelting.

10. A composite material as claimed in claim 1 wherein the three-dimensional pattern is a pattern of regular indentations.

11. A composite material as claimed in claim 10 wherein the indentations are dimples.

12. A composite material as claimed in claim 10 wherein the indentations are circular in shape.

13. A composite material as claimed in claim 10 wherein the indentations are between 30% and 70% of the full thickness of the fabric material.

14. A composite material as claimed in claim 11 wherein each dimple has a diameter which is at its widest part between 2 mm and 12 mm.

15. A composite material as claimed in claim 14 wherein each dimple has a diameter of about 4 mm.

16. A composite material as claimed in claim 11 wherein the adjacent dimpled areas of the fabric material are separated by non-dimpled areas having a minimum width of from 50% to 300% of the diameter of the dimpled areas.

17. A composite material as claimed in claim 1, the material having a felted outer surface composed of entangled fibres, the three-dimensional pattern comprising a series of dimpled areas, at least some of such dimples areas having a surface area ranging from about 3 to 150 $mm^2$.

18. A composite material as claimed in claim 17, wherein the dimpled areas are circular in shape.

19. A composite material as claimed in claim 17, wherein the adjacent dimpled areas of the fabric material are separated by non-dimpled areas having a minimum width of from 50% to 300% of the diameter of the dimpled areas.

20. The use of a composite fabric material as claimed in claim 1 for covering a tennis ball.

21. A composite material as claimed in claim 11 wherein each dimple has a diameter which is at its widest part between 2 mm and 5 mm.

* * * * *